United States Patent [19]

Payne

[11] Patent Number: 5,064,154

[45] Date of Patent: Nov. 12, 1991

[54] STAND AND HOLDER FOR HAIR DRYER

[76] Inventor: Derek Payne, 687 Tall Oaks Blvd., Auburn Hills, Mich. 48057

[21] Appl. No.: 512,349

[22] Filed: Apr. 23, 1990

[51] Int. Cl.[5] ..... A47F 5/00

[52] U.S. Cl. ..... 248/121; 248/314; 248/225.2

[58] Field of Search ..... 248/125, 121, 122, 692, 248/360, 690, 692, 314, 176, 309.1, 225.2, 117.1, 117.2, 301, 303; 34/239, 202, 97; 211/70.6, 33, 37, 69

[56] References Cited

U.S. PATENT DOCUMENTS

| | | | |
|---|---|---|---|
| 3,279,736 | 10/1966 | Vogt, III | 248/225.2 X |
| 3,964,708 | 6/1976 | Reeves | 248/314 X |
| 4,159,773 | 7/1979 | Losenno | 248/117.1 X |
| 4,170,307 | 10/1979 | Maeder | 211/70.6 |
| 4,219,178 | 8/1980 | Assion | 248/314 X |
| 4,225,106 | 9/1980 | Eplan | 248/314 X |
| 4,278,222 | 7/1981 | Siegel | 248/121 |
| 4,278,223 | 7/1981 | Fauteaux | 248/121 X |
| 4,681,233 | 7/1987 | Roth | 211/70.6 |
| 4,696,447 | 9/1987 | Strecker | 248/309.1 X |
| 4,712,313 | 12/1987 | Gettleman | 248/284 X |

FOREIGN PATENT DOCUMENTS

| | | | |
|---|---|---|---|
| 2156962 | 10/1985 | United Kingdom | 248/121 |

*Primary Examiner*—Karen J. Chotkowski

*Attorney, Agent, or Firm*—Cantarella & Associates

[57] ABSTRACT

A portable, free standing apparatus is provided to support or cradle a hand-held electric hair dryer at various heights and angles, allowing the operator of these types of hair dryers free use of both hands while drying hair.

1 Claim, 1 Drawing Sheet

STAND AND HOLDER FOR HAIR DRYER

BACKGROUND OF THE INVENTION

1. Field of Invention

The present invention relates generally to stands. More particularly, the invention is a stand which has a removeable holder, for supporting a hand held electric hair dryer.

2. Description of the Relevant Art

Stands have been known for supporting and holding a wide variety of items and apparatuses. However, different stands and holders are needed for different applications. In the past and presently, there are electric hair dryers in which a stand is integral to their design. However, these devices do not have the desirable features of being lightweight, portable or easily manipulated by hand to achieve a desired drying effect. The alternative to these devices has been the hand held electric hair dryer which is lightweight, portable, and easily manipulated by hand to achieve a desired drying effect. However, being electrically operated, hand held electric hair dryers can be a hazard as they are often operated in bathrooms or hair styling salons where contact with running water or anything electrically grounded would expose the operator to a possible electric shock which could be fatal. As the design of most hand held electric hair dryers precludes stable placement upon a surface for safety reasons the operator must unplug the hair dryer from the electrical power source, which is a great inconvenience. Additionally, placement of a hair dryer upon a surface shared with other items creates a cluttered situation and uses space that might be desired for the placement of other items. Further, a user of a hand held electric hair dryer occasionally desires use of both hands while drying hair and therefore would find a device for supporting a hair dryer while it is being used very useful.

A holding device is shown in U.S. Pat. No. 4,712,313 which teaches an adjustable holder for a hand held electric hair dryer. However, this device has the limitation of not being free standing and further, it supports the hair dryer by the air outlet of the hair dryer leaving the body of the hair dryer unsupported, which places an undesirable weight strain upon the air outlet of the hairdryer which could result in damage to the dryer.

The present invention eliminates these problems and others as it is free standing, portable, and configured to hold and support a hand-held electric hair dryer in a non-damaging fashion.

3. Summary of the Invention

It is an object of the present invention to provide an apparatus which supports and holds a hand-held electric hair dryer to allow a user of these types of hair dryers for use of both hands while drying hair.

It is an additional object of the invention to be free standing while being used.

A further object of the invention is to be readily portable.

A still further object of the invention is to require no accessory tools for its use.

An additional object of the invention is to be adjustable both vertically and horizontally in the material in which it is made being stable, durable, and inexpensive.

These and other objects are realized by providing a stand and holder for supporting a hand-held electric hair dryer at various heights and positions, which includes: a base having an aperture with threads on the inner surface of the aperture; a first upright member configured to be operably engaged with the threaded aperture in the base; a second upright member; a locking member connected to the first upright member which can releasably engage the second upright member at a desired position; a pivoting member connected to the upper most section of the second upright member; a hooking means of at least one part connecting the pivoting member to a holder which is substantially u-shaped when viewed from the front or the side and having an aperture defined within; said holder being provided to support a gun shaped hair dryer by disposing the handle of the hairdryer within the aperture and the holder and resting the air outlet of the hair dryer within the u-shaped depression in the front of the holder. Optionally, the holder could be U-shaped to grip the body of a rectangular hand-held electric hair dryer. These and other aspects of the present invention will be explained in the descriptions of the accompanying drawings.

DETAILED DESCRIPTION OF THE PREFERRED EMBODIMENT

Figure 1:
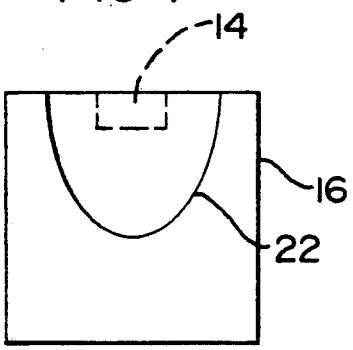
FIG. 1 is a front view of the holder 16, the depression 22 in the front surface of the holder 16, and a hidden view of the second hook-like member 14.

FIG. 1 shows that the depression 22 on the front upper face of the holder 16 is parabolic in configuration, thus allowing air outlets, not shown, of gun shaped hair dryers, not shown, to be disposed within said depression 22. It is further shown that the second hook-like member 14, which is shown as a hidden view, is substantially centered on the width of the holder 16, and connected to the upper edge of the holder 16.

Figure 2:
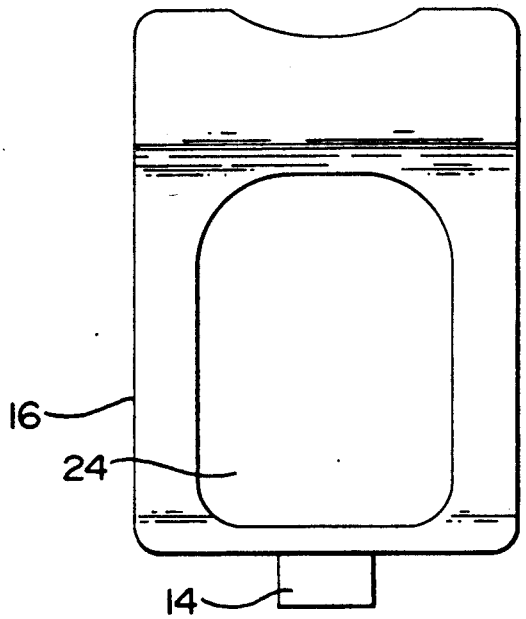
FIG. 2 is a top view of the holder 16, the second aperture 24, and the second hook-like member 14.

FIG. 2 shows the second aperture 24 in the holder 16 which is provided for a handle, not shown, of a gun shaped hair dryer, not shown, to be removeably disposed within. The second hook-like member 14 is shown, but no new significant details of its configuration are revealed than that shown in FIG. 1.

Figure 3:
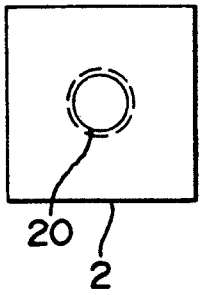
FIG. 3 is a top view of the base 2 and the first aperture 20.
Figure 4:
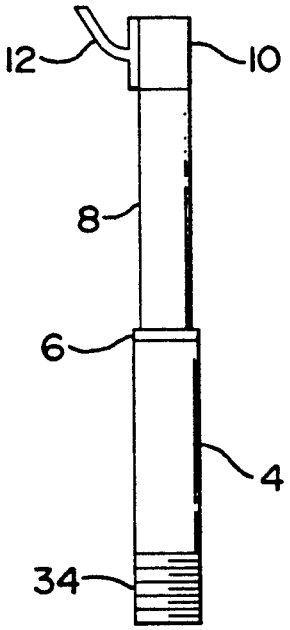
FIG. 4 is a side view of the first upright member 4, the threads 34 thereon, the locking member 6, the second upright member 8, the pivoting member 10, and the first hook-like member 12.
Figure 5:
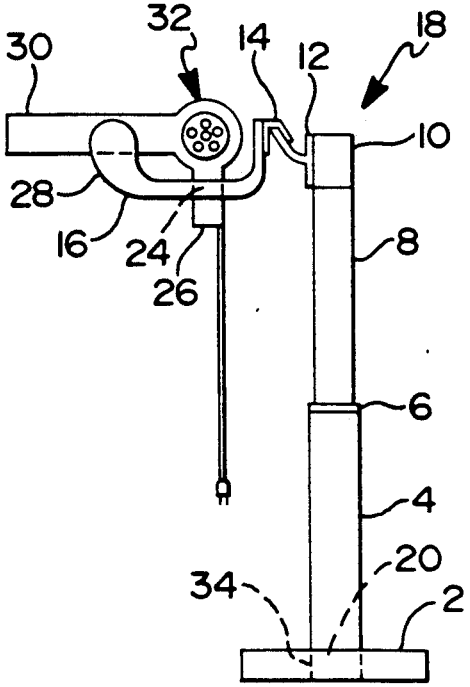
FIG. 5 shows the invention 18 in use with the gun shaped electric hair dryer 32.

FIG. 3 shows the base 2 and the first aperture 20, in a preferred embodiment of the invention the first aperture 20 would be centered in the base 2 to receive maximum stabilization of the invention 18, shown in FIG. 5, when all elements are connected, and the first aperture 20 would have threads defined on the inner surface, not shown, of said first aperture 20, to be operably engaged with the threads 34, shown in FIG. 4, to connect the first upright member 4 to the base 2.

FIG. 4 shows the first upright member 4 with the locking member 6 connected to the uppermost end of the first upright member 4, the second upright member 8 is also connected to the locking member 6 which is connected to the uppermost end of the first upright member 4, the pivoting member 10 is connected to the uppermost end of the second upright member 8, and the first hook like member 12 is connected to the pivoting member 10. Also shown are the threads 34 which are defined upon the lower end of the first upright member 4, said threads 34 provided to connect the first upright member 4 with the base 2 by engaging said threads 34 with the first aperture 20 having threads, not shown, on its inner surfaces.

FIG. 5 shows the invention 18 in use with a gun shaped hair dryer 32. The threads 34 which are defined upon the first upright member 4, are engaged with the first aperture 20, which is defined upon the base 2. The locking member 6 is connected to the first upright member 4 and the second upright member 8, to allow releasable engagement of the first upright member 4 and the second upright member 8 at a desired position. The pivoting member 10 is connected to the second upright member 8 and the first hook like member 12 is connected to the pivoting member 10. The pivoting member 10 allows movement of the first hook like member 12 which is engaged with the second hook like member 14, said second hook like member 14 being connected to the holder 16 which supports the gun shaped hair dryer 32. The handle 26 of the gun shaped hair dryer 32 is shown disposed within the second aperture 24, shown in FIG. 2. The air outlet 30 of the gun shaped hair dryer 32 is supported by and disposed within the depression 22 of the holder 16, said depression being disposed upon the front upwardly curved portion 28 of the holder 16. Optionally, the holder 16 could be configured with a U-shaped depression for gripping the body of a substantially rectangular hand-held electric hair dryer. It is thereby shown that connecting all elements of the invention 18 would provide a device as described throughout the specification.

I claim:

1. An improved stand and holder for supporting a hand held electric hair dryer upon an adjustable stand, said dryer having a substantially gun-like configuration including a handle portion and a barrel portion, the improvement, comprising:

(a) a first hook-like member operably engaged with the stand;

(b) a second hook-like member operably engaged with the first hook-like member;

(c) a holder operably engaged with the second hook-like member;

(d) wherein said holder has a first upwardly curving portion;

(e) wherein said holder has a second upwardly curving portion;

(f) wherein said second hook-like member is operably engaged with the second upwardly curving portion of the holder;

(g) wherein said first and second hook-like members are configured to be releasably engaged with one another;

(h) wherein said holder has an aperture defined between the first and second upwardly curving portions;

(i) wherein said aperture in the holder is configured to permit the insertion of the handle portion of the hair dryer; and (j) wherein said first upwardly curving portion of the holder has a depression defined therein configured to support the barrel portion of the hair dryer.

* * * * *